US005698042A

United States Patent [19]

Sims et al.

[11] Patent Number: 5,698,042

[45] Date of Patent: Dec. 16, 1997

[54] METHOD OF CLEANING FURNACE HEADERS

[75] Inventors: Peggy L. Sims, Seabrook; Joseph L. Greene, Decatur; John W. Hoose, Spring, all of Tex.

[73] Assignee: Praxair Technology, Inc., Danbury, Conn.

[21] Appl. No.: 599,212

[22] Filed: Feb. 9, 1996

[51] Int. Cl.[6] ..... B08B 9/04

[52] U.S. Cl. ..... 134/8; 134/22.1; 15/104.061

[58] Field of Search ..... 134/8, 22.11, 22.12; 15/104.061, 3.5, 3.51

[56] References Cited

U.S. PATENT DOCUMENTS

| | | | |
|---|---|---|---|
| 2,447,966 | 8/1948 | Stephens | 15/104.06 |
| 3,135,322 | 6/1964 | Neugebauer | 134/8 X |
| 3,204,274 | 9/1965 | Knapp | 15/104.06 |
| 3,228,611 | 1/1966 | Russell | 15/3.5 |
| 4,244,073 | 1/1981 | Sagawa | 15/104.06 |
| 4,556,102 | 12/1985 | Bochinski et al. | 134/8 X |
| 4,606,403 | 8/1986 | Fujimoto et al. | 15/3.5 X |
| 4,907,314 | 3/1990 | Kershaw | 15/104.061 |
| 5,150,493 | 9/1992 | Sivacoe | 15/104.061 |
| 5,153,963 | 10/1992 | Saxon et al. | 15/104.061 |
| 5,265,302 | 11/1993 | Sivacoe | 15/104.061 |
| 5,266,169 | 11/1993 | Geary et al. | 15/3.51 X |
| 5,318,074 | 6/1994 | Sivacoe | 138/89 |
| 5,389,155 | 2/1995 | Lima | 134/8 |

*Primary Examiner*—Robert J. Warden
*Assistant Examiner*—Saeed Chaudhry
*Attorney, Agent, or Firm*—Douglas E. Denninger

[57] ABSTRACT

A method for cleaning furnace headers using a cleaning module for cleaning pipes, having a flexible body with a cleaning surface and a nose at each end, the nose being tapered to a tip. The dimensions of the cleaning module are such that the ratio of the overall length to the diameter is about 1.5 to about 1.75 and the ratio of overall length to nose length is about 5 to about 10.

7 Claims, 3 Drawing Sheets

METHOD OF CLEANING FURNACE HEADERS

FIELD OF THE INVENTION

This invention relates to a module, referred to as a Pig, for cleaning a conduit or pipeline and more particularly to a Pig capable of negotiating pipe bends such as headers in furnace piping.

BACKGROUND OF THE INVENTION

Pipes used in a variety of processes often develop undesirable deposits on the inner surface of the pipe wall. These deposits or contaminants are generally known as scale. One method of removing scale involves the use of pipeline cleaning modules, sometimes called Pigs, which are forced through the pipelines under hydraulic pressure. Scale is removed by the scraping action of the Pig against the pipe wall.

The use of Pigs for cleaning pipelines and the general design of the Pig are well known in the art. U.S. Pat. No. 5,150,493, hereby incorporated by reference, discloses a design for such a Pig. The body of the Pig is usually made of a flexible material and has some form of an abrasive surface attached for removing scale. An example of an abrasive surface used comprises removable teeth disposed circumferentially around and extending radially outward from the body. Hydraulic pressure forces the Pig through a pipe while the teeth scrape the deposits from the pipe surface.

Some piping systems include configurations with bends that are difficult for a Pig to navigate such as furnaces and similar apparatus which include pipes that are attached to headers. Generally, where there is a header, gas or liquid flows through the pipes and across a header to the other pipes attached to the header. Plugs are sometimes used to seal off furnace headers when the headers are not being used to access pipes. In the past, cleaning of such pipes and plugged headers often necessitated the expense of replacing a standard plug with a redesigned plug to fit the taper of the header. A redesigned plug in a header transforms the shape of the inside of the header to a more navigable profile. Regular Pigs could then pass through the header with the specifically purchased plug installed. This option however is not always cost effective.

OBJECTS OF THE INVENTION

It is therefore an object of the invention to provide a Pig with dimensions that allow the Pig to navigate a header with a standard plug in place and still clean effectively.

It is a further object of this invention to provide such a Pig with a specific overall length to diameter ratio and an overall length to nose length ratio that defines a shortened Pig to accomplish both effective cleaning and navigating of difficult pipe configurations.

SUMMARY OF THE INVENTION

This invention comprises a cleaning module, for removing scale from pipes with a cleaning surface circumferentially disposed about the body. The invention required that the module has dimensions such that the ratio of overall body length to diameter is about 1.5 to about 1.75 preferably, 1.6 to 1.65 and the ratio of overall length to nose length is about 5 to about 10.

In a preferred embodiment the cleaning module also has a ratio of diameter of the body to the diameter of the tip of the nose of about 2.

BRIEF DESCRIPTION OF THE DRAWING

Other objects, features and advantages will occur to those skilled in the art from the following description of a preferred embodiment and the accompanying drawing, in which.

DETAILED DESCRIPTION OF THE INVENTION

This invention is a shortened cleaning module (Pig) with specific dimensions that allow it to pass through piping with difficult configurations such as plugged headers.

Figure 1:
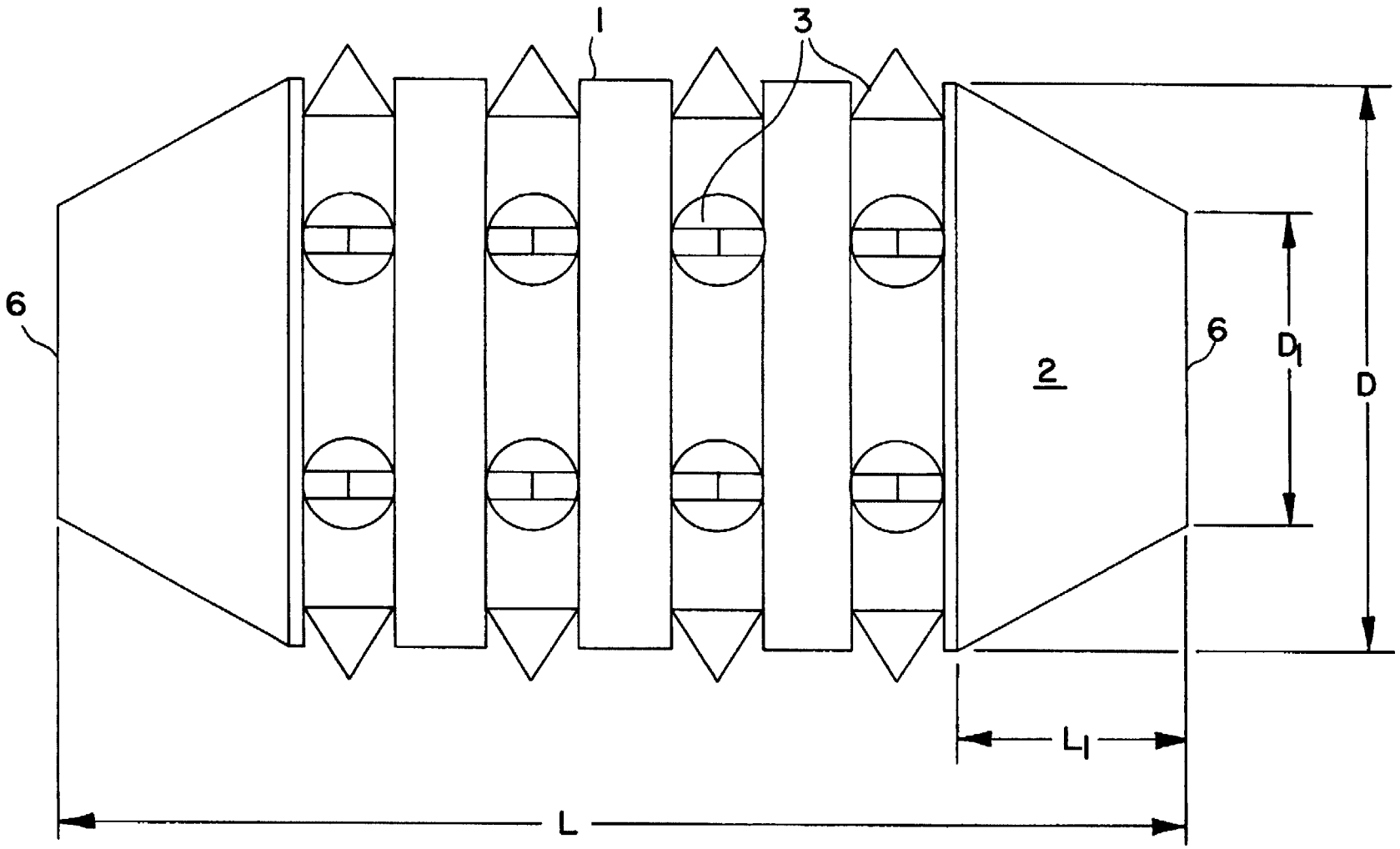
FIG. 1 is a schematic diagram of an embodiment of the invention showing a shortened Pig according to the present invention.

FIG. 1 is a diagram of a preferred embodiment of the invention having a body generally designated as 1 which includes a nose 2 at each end of the body. Abrasive teeth 3 are circumferentially disposed about the wider portion of the body 1, but not necessarily about the nose 2, and provide an abrasive surface for scraping deposits from the pipe through which the Pig is propelled. The frustoconical nose 2 is tapered to a tip 6 having a diameter that is smaller than that of the wider potion of the body 1. The diameter of the nose tip 6 is equal to about ½ the diameter of the wider portion of the body 1 to which the abrasive surface is attached. The Pig 1 is symmetrical with a nose 2 at each end and therefore can be propelled from either direction by a hydraulic fluid (not shown). In practice, the direction of the Pig is reversed after a complete run by applying the hydraulic force from the reverse direction to propel the Pig through the header again. This is done repeatedly until the header and pipes are sufficiently clean as determined by inspection of the fluid exiting the pipe after the Pig completes each pass through the pipe. This inspection may be visual.

In this embodiment, the dimensions of the Pig are such that the ratio of the overall length, L, of the Pig to the diameter of the body, D, is about 1.5 to about 1.75. The ratio of the overall length, L, of the Pig to the length of the nose, L1, is about 5 to about 10.

Water is often used as the hydraulic fluid and applies a greater force to move the Pig along if the amount of water allowed to bypass the Pig is kept to a minimum. The length to diameter ratio of the Pig is significant to the amount of bypass in that the shorter the length of the Pig, the greater the water bypass.

Figure 2:
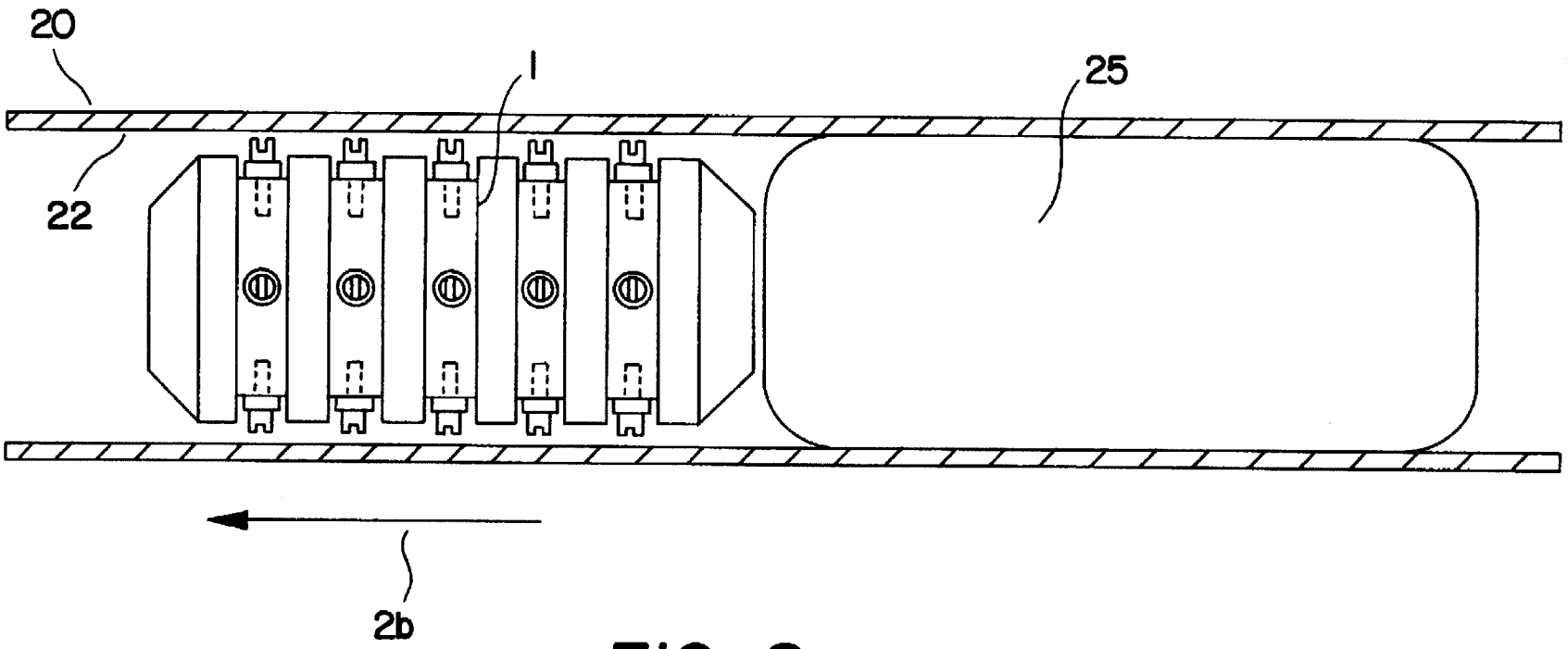
FIG. 2 is a schematic diagram showing the shortened Pig in a conduit with a swab in contact with the Pig.

As shown in FIG. 2, a foam swab 25 can be introduced into the pipe or conduit 20 behind the Pig 1 to provide a tighter seal with the inner pipe wall 22 and therefore reduce water bypass. The swab 25 is propelled by the hydraulic force and pushes the Pig 1 in front of it, through the pipe 20, in the direction shown by arrow 26. This is especially effective as the Pig flexes around pipe bends and headers. As more water is kept behind the Pig 1 by the swab 25, greater driving force is provided to propel the Pig 1 through difficult piping configurations. The foam swab 25 is made of compactable material such as foam and can be in the shape of a flat ended cylinder with a diameter about 1 to 2 inches larger than the pipe diameter. The swab 25 moves easily through the pipe since it is easily deformed to fit any space. One manufacturer of these swabs is Pipeline Pigging Products, Inc. of Houston, Tex.

Figure 3A:
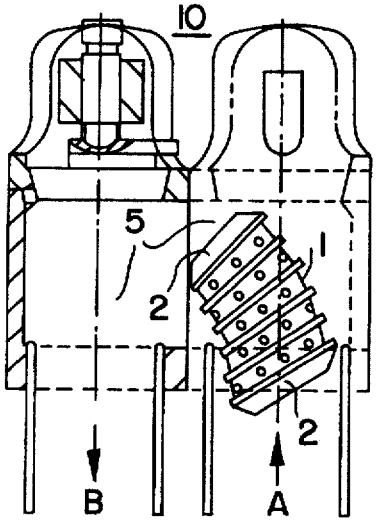
FIG. 3 is a diagram of a header showing the passing of the shortened Pig through the header in three steps (a), (b) and (c).
Figure 3B:
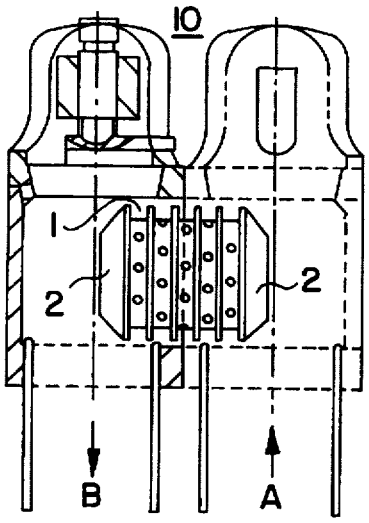
Figure 3C:
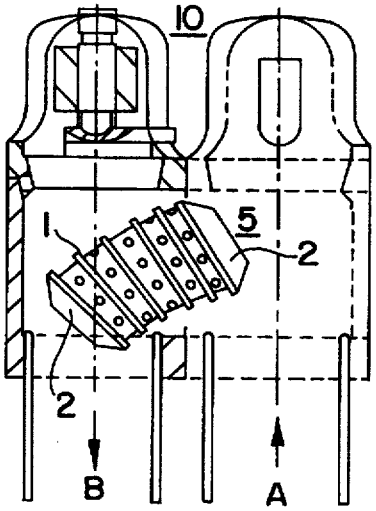

In FIG. 3 the Pig travels from point A to point B through a Mule Ear plugged header generally labeled as 10. A cross-over passage 5 within the header 10 lies between the end of one straight pipe A and the next B. The shortened Pig of the invention, is propelled by water in this embodiment.

As the shortened Pig leaves straight pipe A and enters the header 10 in FIG. 3(*a*), the flow of the hydraulic fluid pushes it into the cross-over passage 5. Because of its shorter length, the break-over point, or the point at which the Pig tilts in the downstream direction, occurs more quickly, allowing the Pig to easily enter the cross-over passage 5. Also, the shorter length of the Pig gives the benefit of having less of the Pig to deform in order to make an unusual bend past the standard plug, thus, it is less likely to break or stick.

The dimensions and flexibility of the Pig allows it to deform and modify its shape sufficiently to fit through the cross-over passage 5 in FIG. 3(*b*). This deformation allows the water flow to continue to push the pig through toward the next straight pipe section, B.

In FIG. 3(*c*) the shorter Pig length is again a benefit at the point where the Pig must bend to enter pipe B since there is less of the Pig to deform and thus break or stick. As the nose 2 of the Pig 1 enters pipe B, the Pig regains its original shape, filling the void on this side of the header. The Pig naturally tends to follow the path of least resistance and leaves the header for the straight pipe. Tests have revealed that a Pig with dimensions of this invention will perform best in plugged headers with cross-over length to width ratio of 1.75 or less.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A method of cleaning a furnace header comprising:

providing a cleaning module having an elongated flexible body with a cleaning surface circumferentially disposed about the body and a nose tapered to a tip, located at each end of the body wherein the body has a ratio of overall length to diameter of about 1.5 to about 1.75 and a ratio of overall length to nose length of about 5 to about 10; propelling said cleaning module in a first direction through the furnace header by a hydraulic fluid;

propelling the cleaning module in a reverse direction through the header; and repeating the propelling step for the first and reverse directions sequentially until the header is sufficiently clean.

2. The method of claim 1 further including introducing a swab into a pipe connected to the furnace header behind and in direct contact with the cleaning module.

3. The method of claim 1 wherein the header is determined to be sufficiently clean by visually inspecting the fluid exiting a pipe connected to the furnace header, after the cleaning module has passed through, and finding essentially no scale present.

4. The method of claim 1 wherein the ratio of the diameter of the body to the diameter of the tip of the nose is about 2.

5. The method of claim 1 wherein the ratio of overall length to diameter is about 1.6 to about 1.65.

6. The method of claim 1 wherein the nose of the cleaning module has a frustoconical shape.

7. The method of claim 1 wherein the furnace header has a maximum cross-over length to width ratio of 1.75.

* * * * *